US008695285B2

(12) United States Patent
Reinmann, Jr. et al.

(10) Patent No.: US 8,695,285 B2
(45) Date of Patent: Apr. 15, 2014

(54) TELESCOPING MODULAR SHELTER AND METHOD

(75) Inventors: John J. Reinmann, Jr., Alpharetta, GA (US); Anthony Farrugia, Melbourne (AU)

(73) Assignee: Strata Products Worldwide, LLC, Sandy Springs, GA (US)

( * ) Notice: Subject to any disclaimer, the term of this patent is extended or adjusted under 35 U.S.C. 154(b) by 19 days.

(21) Appl. No.: 13/317,271

(22) Filed: Oct. 13, 2011

(65) Prior Publication Data

US 2013/0091783 A1 Apr. 18, 2013

(51) Int. Cl.

| | |
|---|---|
| ***E04H 9/16*** | (2006.01) |
| ***E04B 1/66*** | (2006.01) |
| ***E04B 1/343*** | (2006.01) |
| ***E04H 9/14*** | (2006.01) |
| ***E04H 1/00*** | (2006.01) |

(52) U.S. Cl.

USPC ..... 52/79.5; 52/64; 52/67; 52/741.4; 299/12

(58) Field of Classification Search

CPC ..... E04B 1/34305; E04B 1/3431; E04H 9/16; A62B 31/00

USPC ..... 52/79.5, 64, 67, 71, 72, 79.1, 741.4; 299/10, 12, 95

See application file for complete search history.

(56) References Cited

U.S. PATENT DOCUMENTS

| | | | | | |
|---|---|---|---|---|---|
| 2,827,004 | A | * | 3/1958 | Luce et al. | 109/1 S |
| 3,539,070 | A | * | 11/1970 | Dunlea, Jr. | 220/8 |
| 3,566,554 | A | * | 3/1971 | Schaffer et al. | 52/64 |
| 3,745,725 | A | * | 7/1973 | Boucaud | 52/67 |
| 3,864,771 | A | * | 2/1975 | Bauer | 441/30 |
| 4,115,656 | A | * | 9/1978 | Aitel | 174/380 |
| 4,133,571 | A | * | 1/1979 | Fillios | 296/165 |
| 4,271,644 | A | * | 6/1981 | Rilliet | 52/67 |
| 4,562,979 | A | * | 1/1986 | Taylor | 244/159.4 |
| 4,674,241 | A | * | 6/1987 | Sarrazin | 52/67 |
| 4,815,363 | A | * | 3/1989 | Harvey | 454/168 |
| 4,964,597 | A | * | 10/1990 | Hijazi | 244/159.4 |
| 4,987,706 | A | * | 1/1991 | Hughes et al. | 52/79.5 |
| 5,086,999 | A | * | 2/1992 | Mullen | 244/159.4 |
| 5,237,782 | A | | 8/1993 | Cooper | |
| 5,326,211 | A | * | 7/1994 | Critchley | 414/217 |
| 5,537,784 | A | * | 7/1996 | Baldwin | 52/2.17 |

(Continued)

FOREIGN PATENT DOCUMENTS

| | | | |
|---|---|---|---|
| DE | 8704301 | U1 * | 5/1987 |
| DE | 202007001052 | U1 * | 5/2007 |

(Continued)

*Primary Examiner* — Basil Katcheves

*Assistant Examiner* — Rodney Mintz

(74) *Attorney, Agent, or Firm* — Ansel M. Schwartz

(57) ABSTRACT

A shelter to protect users from an external environment has an inner front module having an airlock and an outer front module which is slidingly attached to the inner front module. The shelter has an inner rear module and an outer rear module slidingly attached to the inner rear module. When the outer front module and the inner front module are in an extended state and the outer rear module and the inner rear module are in an extended state and the outer front module and outer rear module are attached, they form an airtight chamber in which users are protected from the external environment. A method for constructing a shelter to protect users from an external environment is also disclosed.

15 Claims, 9 Drawing Sheets

(56) References Cited

U.S. PATENT DOCUMENTS

| | | | | |
|---|---|---|---|---|
| 5,806,799 | A * | 9/1998 | Lounge | 244/159.4 |
| 5,894,698 | A | 4/1999 | Dewald, Jr. | |
| 6,108,983 | A * | 8/2000 | Dewald et al. | 52/67 |
| 6,226,932 | B1 * | 5/2001 | Friedrich | 52/79.1 |
| 6,354,457 | B1 * | 3/2002 | Aaron | 220/582 |
| 6,561,570 | B2 * | 5/2003 | Gehman et al. | 296/171 |
| 6,772,563 | B2 * | 8/2004 | Kuhn | 52/67 |
| 7,290,372 | B2 * | 11/2007 | Aust et al. | 52/67 |
| 7,293,814 | B2 * | 11/2007 | Blodgett, Jr. | 296/26.01 |
| 7,418,802 | B2 * | 9/2008 | Sarine et al. | 52/79.5 |
| 7,533,942 | B2 * | 5/2009 | Kennedy et al. | 299/12 |
| 7,823,337 | B2 * | 11/2010 | Pope | 52/67 |
| 7,895,794 | B2 * | 3/2011 | Pope | 52/67 |
| 7,926,226 | B2 * | 4/2011 | Pope | 52/67 |
| 7,930,857 | B2 * | 4/2011 | Pope | 52/67 |
| 7,941,974 | B2 * | 5/2011 | VanBasten et al. | 52/2.11 |
| 8,007,047 | B2 * | 8/2011 | Kennedy et al. | 299/12 |
| 8,136,303 | B2 * | 3/2012 | Scott, IV | 52/2.25 |
| 8,136,306 | B2 * | 3/2012 | Scheps | 52/67 |
| 8,151,537 | B2 * | 4/2012 | Pope | 52/745.02 |
| 8,209,937 | B2 * | 7/2012 | Scheps | 52/747.1 |
| 8,245,450 | B2 * | 8/2012 | Scott | 52/2.11 |
| 8,484,908 | B2 * | 7/2013 | Hache | 52/143 |
| 8,506,681 | B2 * | 8/2013 | Paton-Ash et al. | 95/139 |
| 8,544,216 | B1 * | 10/2013 | Hazlett | 52/79.5 |
| 8,561,358 | B2 * | 10/2013 | Rowan | 52/79.1 |
| 2002/0089213 | A1 * | 7/2002 | Gehman et al. | 296/171 |
| 2002/0092854 | A1 * | 7/2002 | Aaron | 220/581 |
| 2003/0024928 | A1 * | 2/2003 | Serden | 220/4.04 |
| 2003/0029099 | A1 * | 2/2003 | Torata | 52/67 |
| 2004/0216395 | A1 * | 11/2004 | Wentworth, Jr. | 52/79.5 |
| 2005/0055891 | A1 * | 3/2005 | Kuebler | 52/79.1 |
| 2005/0072062 | A1 * | 4/2005 | Aust et al. | 52/79.1 |
| 2005/0235819 | A1 * | 10/2005 | Long | 89/36.07 |
| 2006/0254160 | A1 * | 11/2006 | Lee | 52/67 |
| 2007/0199244 | A1 * | 8/2007 | Kennedy et al. | 49/70 |
| 2007/0200420 | A1 * | 8/2007 | McCormick | 299/95 |
| 2008/0106137 | A1 * | 5/2008 | Paton-Ash et al. | 299/12 |
| 2008/0263967 | A1 | 10/2008 | Culveyhouse | |
| 2009/0300997 | A1 * | 12/2009 | Scheps | 52/67 |
| 2010/0018391 | A1 | 1/2010 | Whittaker et al. | |
| 2010/0024314 | A1 * | 2/2010 | Pope | 52/67 |
| 2010/0024315 | A1 * | 2/2010 | Pope | 52/67 |
| 2010/0024316 | A1 * | 2/2010 | Pope | 52/79.5 |
| 2010/0024317 | A1 * | 2/2010 | Pope | 52/79.5 |
| 2010/0024319 | A1 * | 2/2010 | Pope | 52/79.9 |
| 2010/0024322 | A1 * | 2/2010 | Pope | 52/126.1 |
| 2010/0024349 | A1 * | 2/2010 | Pope | 52/745.02 |
| 2010/0024350 | A1 * | 2/2010 | Pope | 52/745.02 |
| 2010/0024351 | A1 * | 2/2010 | Pope | 52/745.02 |
| 2010/0024352 | A1 * | 2/2010 | Pope | 52/745.02 |
| 2010/0024353 | A1 * | 2/2010 | Pope | 52/745.02 |
| 2010/0043309 | A1 * | 2/2010 | Martin et al. | 52/79.5 |
| 2010/0088974 | A1 * | 4/2010 | Scott, IV | 52/79.5 |
| 2010/0139179 | A1 * | 6/2010 | Smith et al. | 52/67 |
| 2011/0214362 | A1 * | 9/2011 | Huang | 52/79.5 |
| 2012/0031013 | A1 * | 2/2012 | Scheps | 52/67 |
| 2012/0151851 | A1 * | 6/2012 | Cantin et al. | 52/79.5 |
| 2012/0167484 | A1 * | 7/2012 | Bernard | 52/79.5 |
| 2012/0242206 | A1 * | 9/2012 | Gasser | 312/236 |
| 2013/0049436 | A1 * | 2/2013 | Paton-Ash | 299/12 |
| 2013/0305625 | A1 * | 11/2013 | Pike et al. | 52/64 |
| 2013/0305627 | A1 * | 11/2013 | Pike et al. | 52/79.5 |

FOREIGN PATENT DOCUMENTS

| | | | |
|---|---|---|---|
| EP | 2281716 | A1 * | 2/2011 |
| FR | 2296738 | A * | 7/1976 |
| GB | 2225040 | A * | 5/1990 |
| GB | 2479680 | A * | 10/2011 |
| GB | 2495604 | A * | 4/2013 |
| JP | 07330075 | A * | 12/1995 |

* cited by examiner

TELESCOPING MODULAR SHELTER AND METHOD

FIELD OF THE INVENTION

The present invention is related to a shelter comprising modules that are transported in a compact state to a desired location and then expanded to an extended state and attached together to form an airtight chamber in which users are protected from an external environment. (As used herein, references to the "present invention" or "invention" relate to exemplary embodiments and not necessarily to every embodiment encompassed by the appended claims.) More specifically, the present invention is related to a shelter comprising modules that are transported in a compact state to a desired location and then expanded to an extended state and attached together to form an airtight chamber in which users are protected from an external environment where the modules include an inner front module having an airlock, an outer front module which is slidingly attached to the inner front module and which slides over the inner front module between a compact state, and an extended state; and an inner rear module and an outer rear module sliding attached to the inner rear module and which slides over the inner rear module between a compact state and an extended state.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

In many mines, entry and exit from the main workings is via a shaft. These shafts are fitted with steel cages that allow people and equipment to be transported in and out. The cage is connected by a steel cable, and controlled by a large winder (a big wheel to roll the cable up and down).

In portal type mining, vehicles can be driven down an inclination to the working areas however. Shaft mines have heavy restrictions to sizes and weights. Most shaft mine cages are less than 2 meters×2 meters×2 meters (2 yards 0.562 ft.×2 yards 0.562 ft.×2 yards 0.562 ft.) in size; therefore, the ability to place large objects underground becomes very difficult.

The present invention addresses the issue of large part assembly and use in these confined space mines.

BRIEF SUMMARY OF THE INVENTION

The present invention pertains to a shelter to protect users from an external environment. The shelter comprises an inner front module having an airlock. The shelter comprises an outer front module which is slidingly attached to the inner front module. The outer front module slides over the inner front module between a compact state, where the outer from module essentially envelops the inner front module, and an extended state, where the inner front module extends from the outer front module and there is an airtight seal between the inner front module and the outer front module. The outer front module having a front attachment portion. The shelter comprises an inner rear module. The shelter comprises an outer rear module sliding attached to the inner rear module. The outer rear module slides over the inner rear module between a compact state where the outer rear module essentially envelops the inner rear module, and an extended state where the inner rear module extends from the outer rear module and there is an airtight seal between the inner rear module and the outer rear module. The outer rear module having a rear attachment portion through which the outer rear module is attached to the front attachment portion of the outer front module. When the outer front module and the inner front module are in the extended state and the outer rear module and the inner rear module are in the extended state and the outer front module and outer rear module are attached, they form an airtight chamber in which users are protected from the external environment.

The present invention pertains to a method for constructing a shelter to protect users from an external environment. The method comprises the steps of extending an inner front module having an airlock from an outer front module which is slidingly attached to the inner front module from a compact state, where the outer front module essentially envelops the inner front module, to an extended state, where the inner front module extends from the outer front module and there is an airtight seal between the inner front module and the outer front module. The outer front module slides over the inner front module between a compact state and an extended state. Outer front module having a front attachment portion. There is the step of extending an inner rear module from an outer rear module which is slidingly attached to the inner rear module from a compact state, where the outer rear module essentially envelops the inner front module, to an extended state, where the inner rear module extends from the outer rear module and there is an airtight seal between the inner rear module and the outer rear module. The outer rear module slides over the inner rear module between a compact state and an extended state. The outer front module having a rear attachment portion. There is the step of attaching the outer front module to the outer rear module through the attachment portion of the outer front module and the attachment portion of the outer rear module to form an airtight chamber in which users are protected from the external environment.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 6:
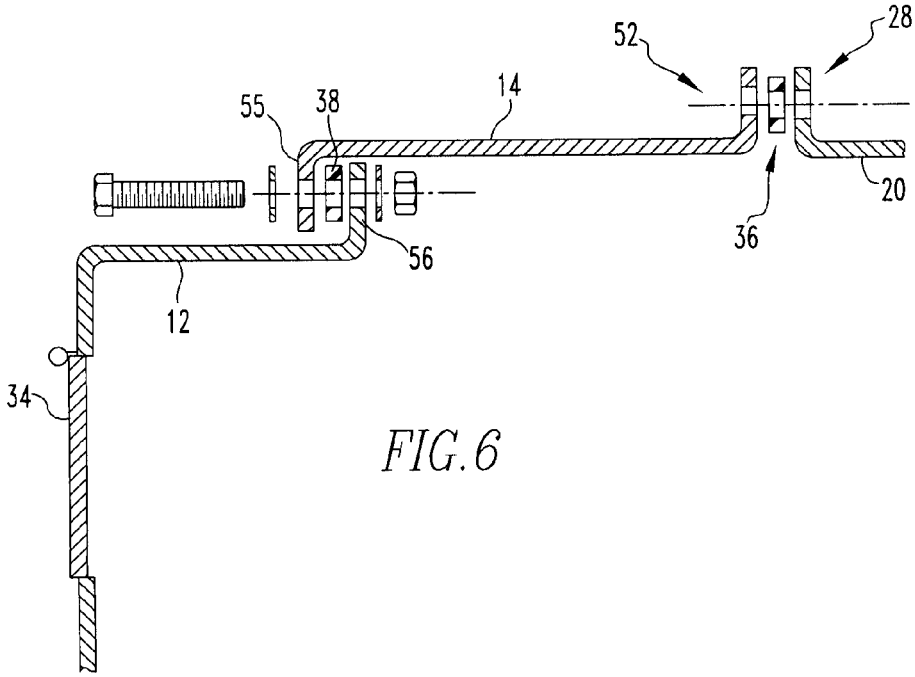
FIG. 6 is a detailed view of the joints between the outer and inner front modules, and the outer front module and the center module.
Figure 7:
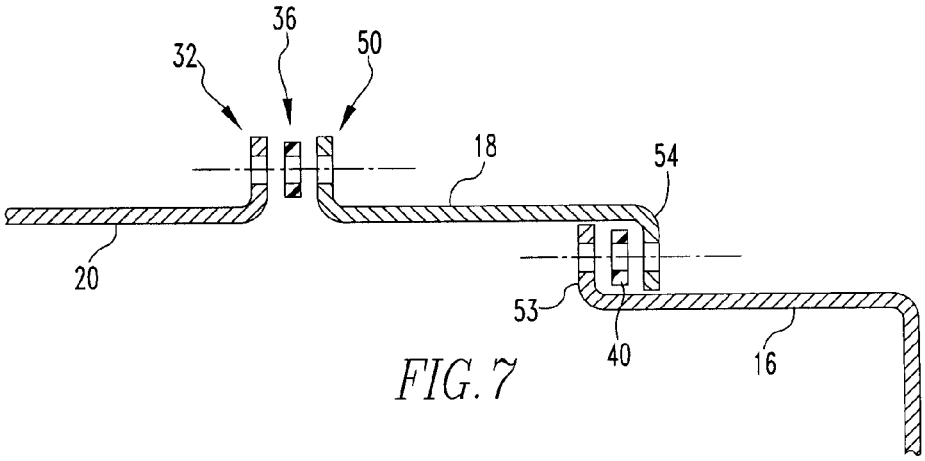
FIG. 7 is a detailed view of the joints between the outer and inner rear modules, and the outer rear module and the center module.
Figure 8:
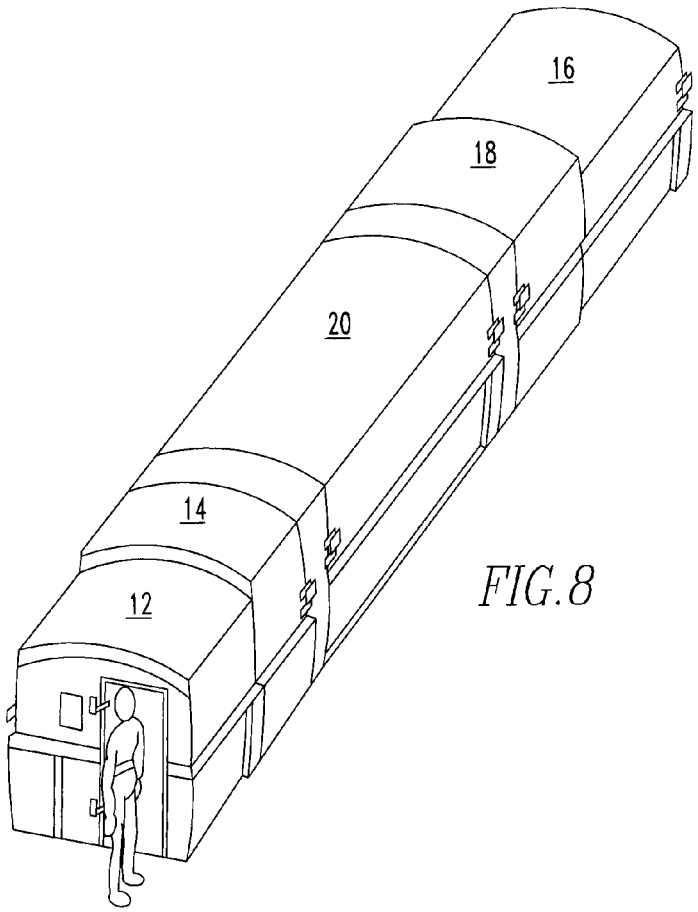
FIG. 8 is an overhead perspective you of the assembled shelter of the present invention.
Figure 9:
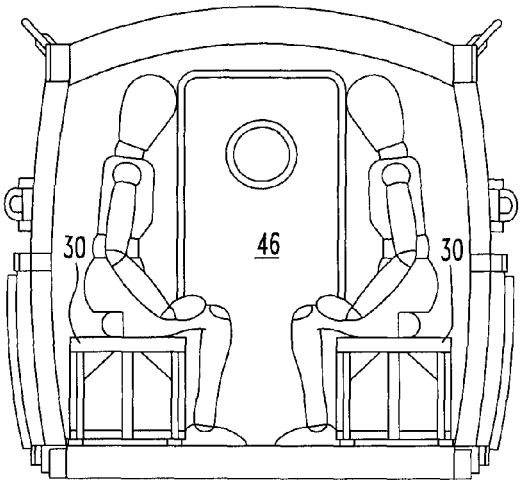
FIG. 9 is a rear view of the outer front module.
Figure 10:
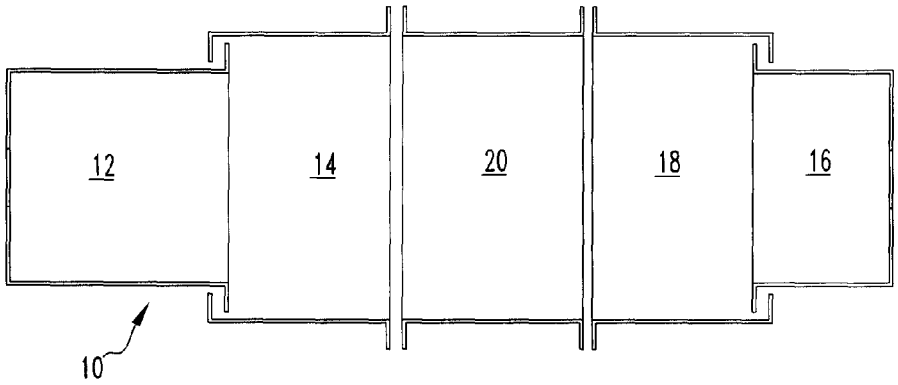
FIG. 10 is a sectional view of the modules of the shelter of the present invention.

Referring now to the drawings wherein like reference numerals refer to similar or identical parts throughout the several views, and more specifically to FIGS. 1-7 thereof, there is shown a shelter 10 to protect users from an external environment. The shelter 10 comprises an inner front module 12 having an airlock 22. The airlock 22 has an external door 34 through which users enter the airlock 22. The shelter 10 comprises an outer front module 14 which is slidingly attached to the inner front module 12. The outer front module 14 slides over the inner front module 12 between a compact state, where the outer from module essentially envelops the inner front module 12, and an extended state, where the inner front module 12 extends from the outer front module 14 and there is an airtight seal 38 between the inner front module 12 and the outer front module 14. The outer front module 14 having a front attachment portion 52. The shelter 10 comprises an inner rear module 16. The shelter 10 comprises an outer rear module 18 sliding attached to the inner rear module 16. The outer rear module 18 slides over the inner rear module 16 between a compact state where the outer rear module 18 essentially envelops the inner rear module 16, and an extended state where the inner rear module 16 extends from the outer rear module 18 and there is an airtight seal 40 between the inner rear module 16 and the outer rear module 18. The outer rear module 18 having a rear attachment portion 50 through which the outer rear module 18 is attached to the front attachment portion 52 of the outer front module 14. When the outer front module 14 and the inner front module 12 are in the extended state and the outer rear module 18 and the inner rear module 16 are in the extended state and the outer front module 14 and outer rear module 18 are attached, as shown in FIG. 8, they form an airtight chamber 24 in which users are protected from the external environment. Users access the chamber 24 from the airlock 22 through an internal door 46 of the airlock 22, as shown in FIG. 9, which communicates with the chamber 24. FIG. 10 shows the relationship of modules.

Figure 1:
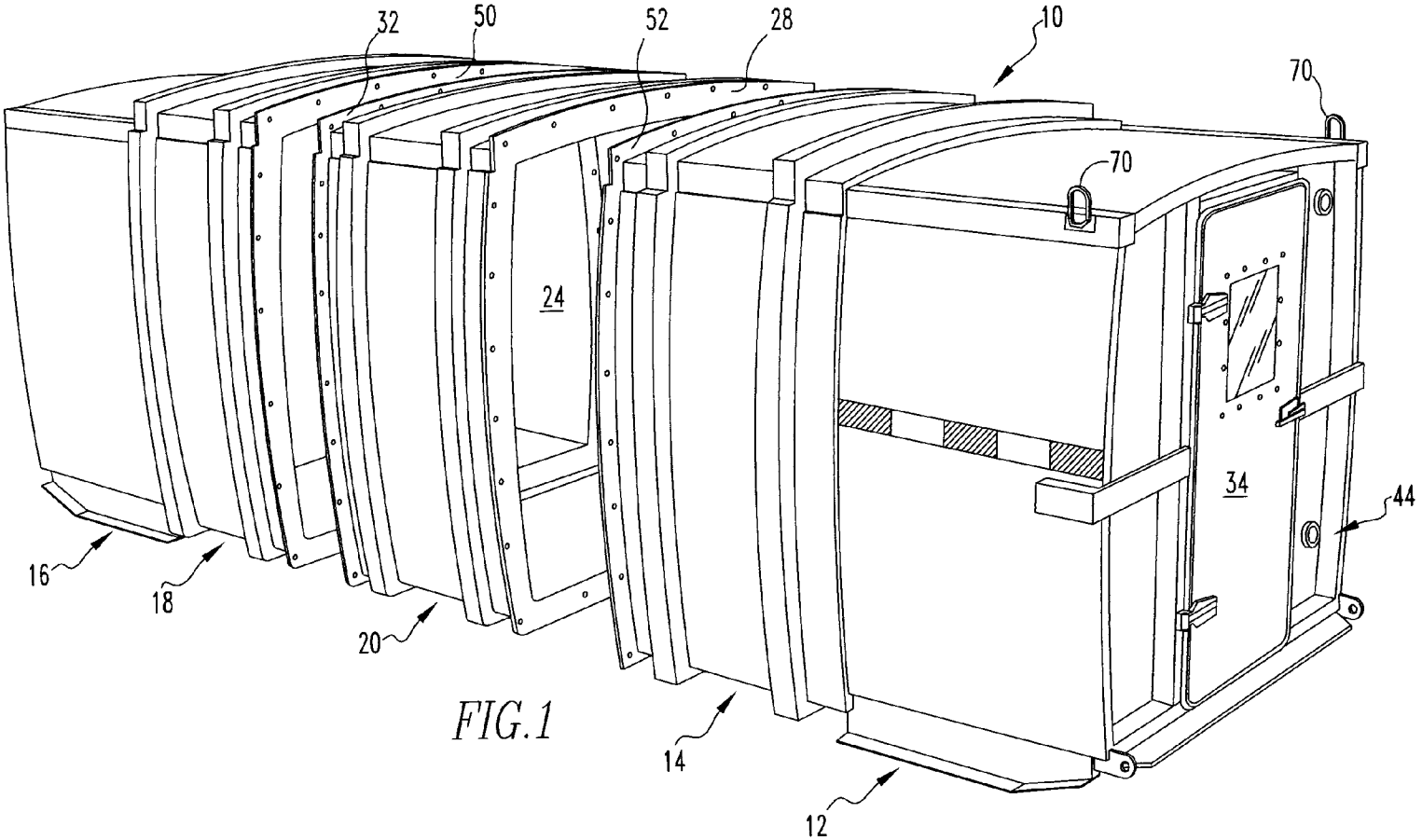
FIG. 1 is a perspective view of the shelter of the present invention with its front, center and rear modules unattached.
Figure 2:
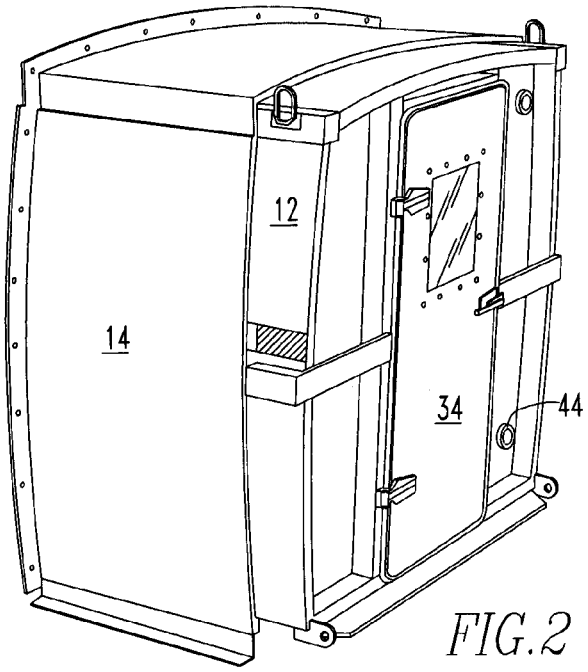
FIG. 2 is a front perspective view of the outer and inner front modules in a compact state.
Figure 3:
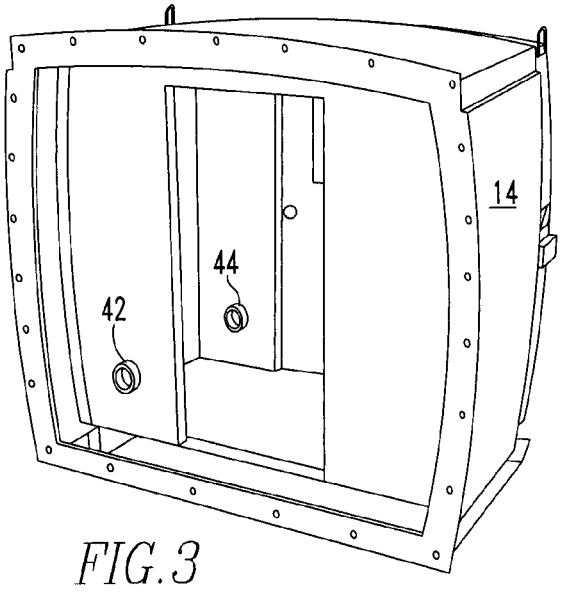
FIG. 3 is a rear perspective view of the outer and inner front modules in a compact state.
Figure 11:
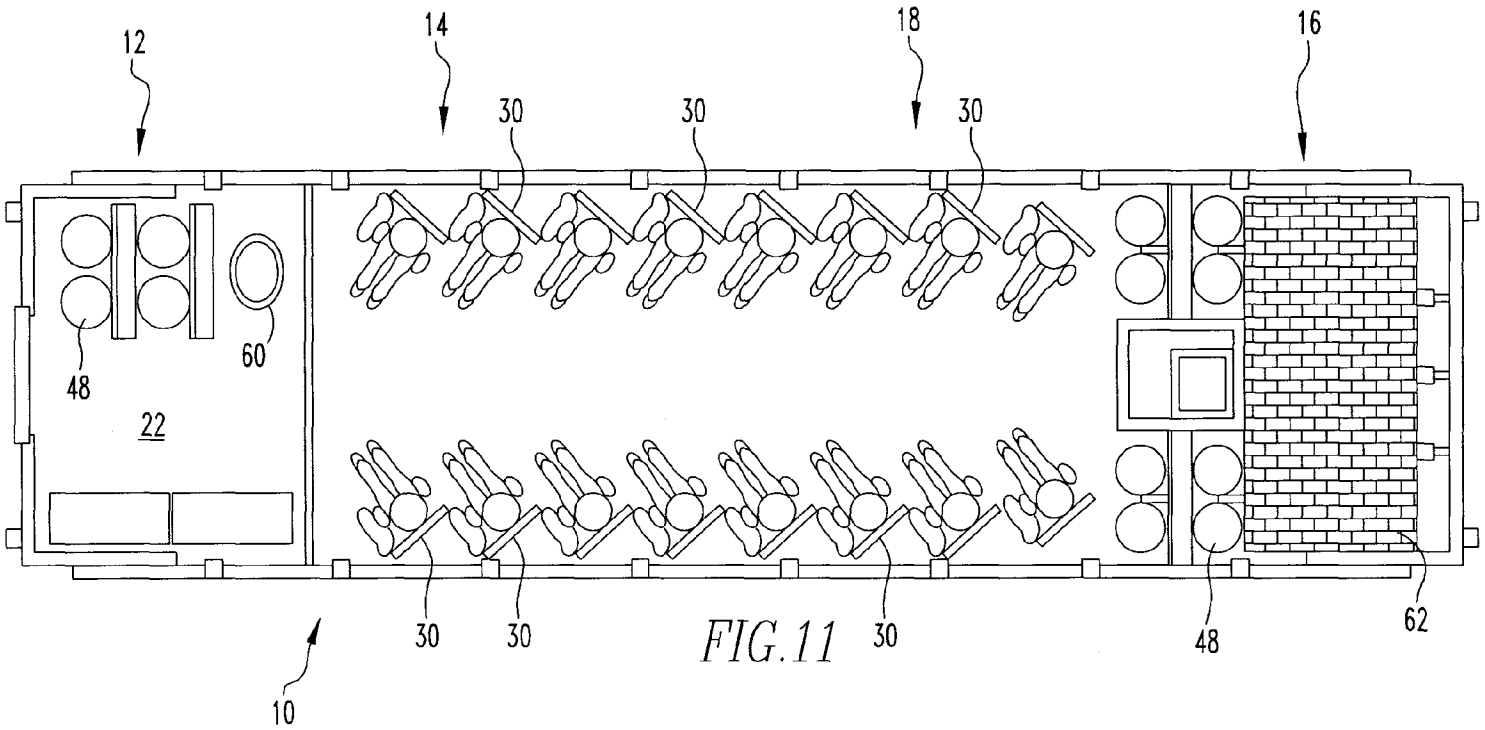
FIG. 11 is an overhead cutaway view of a shelter for non-coal applications.
Figure 12:
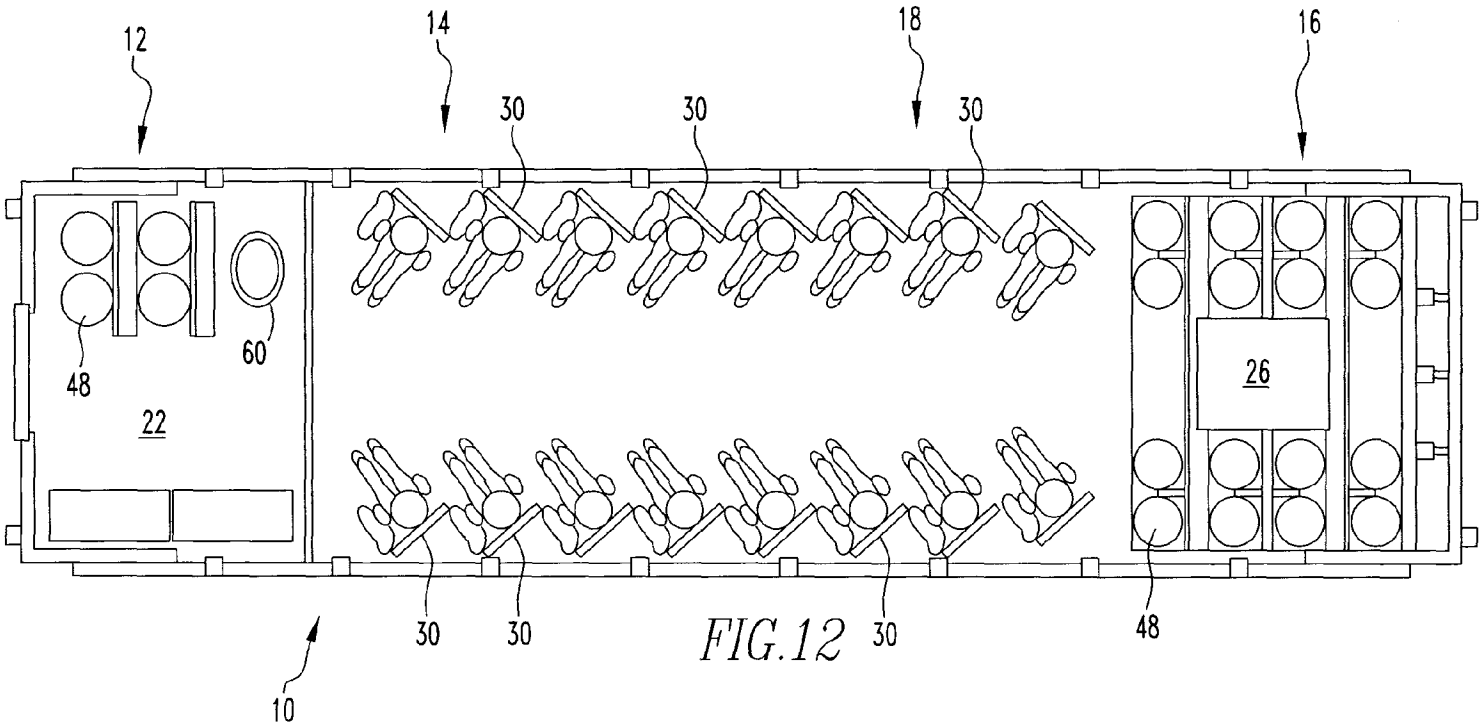
FIG. 12 is an overhead cutaway view of a shelter for coal applications.

The shelter 10 may include a center module 20 having a center front attachment portion 28, through which the center module 20 is removably attached to the front attachment portion 52 of the outer front module 14, and a center rear attachment portion 32, through which the center module 20 is removably attached to the rear attachment portion 50 of the outer rear module 18, as shown in FIG. 1. When the center module 20 is attached to the outer rear module 18 and the outer front module 14 they form the airtight chamber 24. The inner rear module 16 may have a gas scrubber 26 for removing $CO_2$ from the chamber 24, as shown in FIG. 12, which shows an embodiment of the shelter 10 for coal mine use. See U.S. patent application Ser. No. 12/075,002 as an example of a scrubber 26, incorporated by reference herein. FIG. 11 shows an embodiment for non coal mine use.

The inner rear module 16 may have breathable gas cylinders 48 for supplying breathable gas to the chamber 24, as shown in FIGS. 11 and 12. The airlock 22 of the inner front module 12 may have breathable gas cylinders 48 for purging the airlock 22. The airlock 22 may have an airlock 22 purge valve 44, positioned for instance on the front wall of the inner front module 12, through which gas above a certain pressure in the airlock 22 escapes to the external environment. There may be a pressure valve 42 positioned on the interior airlock 22 wall through which gas in the chamber 24 escapes into the airlock 22 and then through the purge valve 44 to the external environment when the gas pressure in the chamber 24 is above a predetermined level. The outer front module 14 and the inner outer rear module 18 may have seats 30 for users to sit in and the inner front module 12 has a toilet 60. The seats 30 may fold against the wall until needed for deployment and also be sat at an angle relative to the center line of the shelter.

The inner front module 12 may have an inner front flange 56 and the outer front module 14 has an outer front flange 55 with a front seal 38 between the inner front flange 56 and the outer front flange 55 when they are attached together, as shown in FIG. 6. The inner rear module 16 may have an inner rear flange 53 and the outer rear module 18 has an outer rear flange 54 with a rear seal 40 between the inner rear flange 53 and the outer rear flange 54 when they are attached together, as shown in FIG. 7. Each module may be made of metal and is explosion proof to withstand a force up to 15 PSI. For instance, the walls of the modules may be about 6 mm (0.2362204724 inches) thick steel plate with reinforced internal and external steel ribs. Each attachment portion may be an external flange, and there is an external seal 36 between each attachment portion that is attached together. The inner rear module 16 may include batteries and a cooling system, 62, as shown in FIG. 11. The seals 36 may be a gasket made of rubber. The outer front module 14 may have a loop 70 by which the outer front module 14 is lifted and placed in a transfer cage to be lowered into a mine.

The present invention pertains to a method for constructing a shelter 10 to protect users from an external environment. The method comprises the steps of extending an inner front module 12 having an airlock 22 from an outer front module 14 which is slidingly attached to the inner front module 12 from a compact state, where the outer front module 14 essentially envelops the inner front module 12, to an extended state, where the inner front module 12 extends from the outer front module 14 and there is an airtight seal between the inner front module 12 and the outer front module 14. The outer front module 14 slides over the inner front module 12 between a compact state and an extended state. Outer front module 14 having a front attachment portion 52. There is the step of extending an inner rear module 16 from an outer rear module 18 which is slidingly attached to the inner rear module 16 from a compact state, where the outer rear module 18 essentially envelops the inner front module 12, to an extended state, where the inner rear module 16 extends from the outer rear module 18 and there is an airtight seal between the inner rear module 16 and the outer rear module 18. The outer rear module 18 slides over the inner rear module 16 between a compact state and an extended state. The outer front module 14 having a rear attachment portion 50. There is the step of attaching the outer front module 14 to the outer rear module 18 through the attachment portion of the outer front module 14 and the attachment portion of the outer rear module 18 to form an airtight chamber 24 in which users are protected from the external environment.

There may be the steps of attaching a center module 20 to the outer front attachment portion through a center front attachment portion 28 of the center module 20 and the front attachment portion 52 of the outer front module 14, and attaching the center portion to the outer rear portion through a center rear attachment portion 32 and to the rear attachment portion 50 of the outer rear module 18 to form the airtight chamber 24. There may be the steps of moving the inner and outer front module 14 in the compact state to a desired location, moving the inner and outer rear module 18 in a compact state to a desired location adjacent the inner and outer front module 14 and moving the center module 20 to a desired location adjacent the inner and outer front module 14. There may be the steps of an outer flange on the outer front module 14 resting on the roof or outer walls of the inner front module 12 as they slide apart, and an inner flange on the inner front module 12 has the roof and inner walls of the outer front module 14 resting on the inner flange until the inner front module 12 and the outer front module 14 are fully extended where the inner and outer flanges contact each other with a seal between them; and bolting together the inner and outer flanges in the extended position.

Figure 4A:
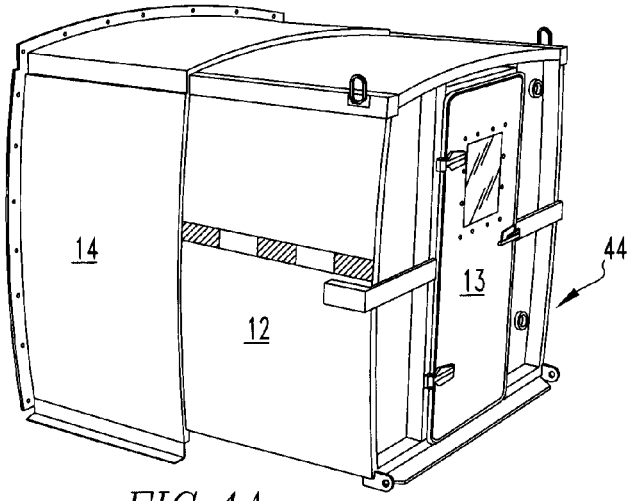
FIG. 4*a* is a front perspective view of the outer and inner front modules in an extended state.
Figure 4B:
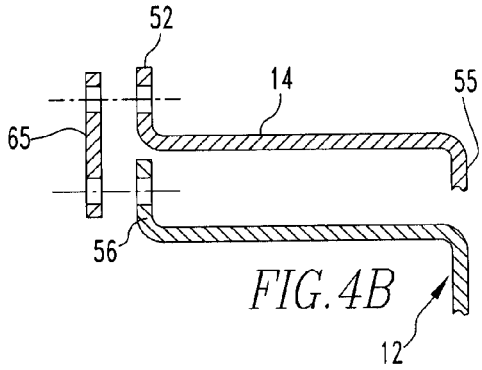
FIG. 4*b* is a detailed view of the attachment of the inner front flange with the front attachment portion by a bracket.
Figure 5:
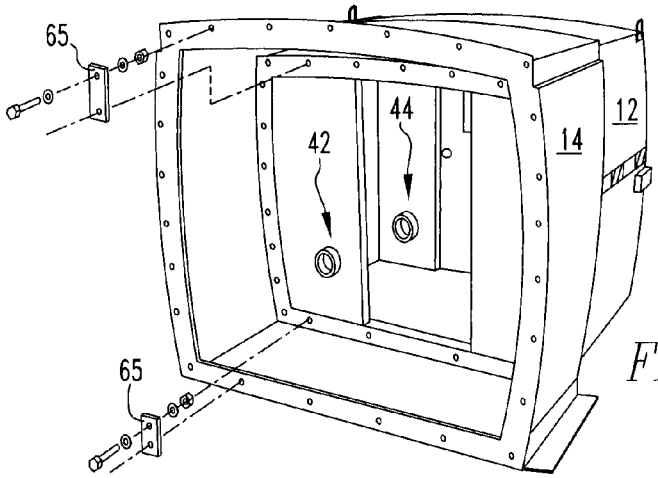
FIG. 5 is a rear perspective view of the outer and inner front modules in an extended state.

In the operation of the invention, the shelter 10 can be placed into a transfer cage, lowered down into position, in two or more parts. The inner and outer front modules and the inner and outer rear modules are bolted together with steel brackets 65, as shown in FIG. 4*b*, during transport. When in the compact state, the inner front flange 56 of the inner front module 12 and the front attachment portion 52 of the outer front module 14 are essentially flush. One steel bracket 65 at the top and one steel bracket 65 at the bottom are bolted to the inner front flange 56 and front attachment portion 52 to hold the inner and outer front modules in place. Similarly, when in the compact state, the inner rear flange 53 of the inner rear module 16 and the rear attachment portion 50 of the outer rear module 18 are essentially flush. One steel bracket 65 at the top and one steel bracket 65 at the bottom are bolted to the inner rear flange 53 and rear attachment portion 50 to hold the inner and outer rear modules in place. Once in the correct location, the brackets 65 are removed and the inner and outer modules are expanded to form one piece. It should be noted to place inner and outer modules together, when the inner module is initially placed into the outer module, the front flange of the outer module is lifted up so the inner flange will pass by the outer flange and not be blocked by it. The inner flange may also be pushed down to pass by the outer flange.

After expanding the inner and outer front modules then expanding the inner and outer rear modules, they are bolted together to form one large assembly with the chamber 24. If needed, one or more additional center modules can be fitted which further increases the internal seating capacity of the chamber 24. As an example, each module may be about 1.4 m (1 yd. 1.593 ft.) wide×1.8 m (1 yd. 2.91 ft.) high×1.8 m (1 yd. 2.91 ft.) long.

As opposed to standard bolt together modular shelters, the shelter 10 allows two parts to be lowered into position at one time. The shelter 10 also provides varying cross sectioning of assemblies, which provides additional strength to the shelter 10.

Shelter 10 design and application:

1. COAL MINES (Mines that require explosion proof structures)
2. NON COAL MINES (also known as Hard rock, these mines include all mining types metal, non-metal, precious metals, salt and limestone)
3. Other Underground applications including but not limited to, Tunnel building, Chemical Plants, Toxic environments.

The Shelter 10 Comprises:

1. An inner front module 12
2. An outer front module 14
3. An inner rear module 16
4. An outer rear module 18
5. A center module 20

1. The Inner Front Module 12.
   a. The inner front module 12 will be used as an airlock 22, and be the first entry point for miners prior to entry into the outer front module 14.
   b. The inner front module 12 area will be positive pressure and have air flushing OR purging air capabilities.
2. The Outer Front Module 14
   a. The outer front module 14 will slide over the inner front module 12 and have solid fixing along the flange joints where both meet, using bolts and nuts. This area will also be fitted with a seal 38 as to stop any gas entering the jointed modules.
   b. The outer front module 14 will have removable seats 30 attached to each side wall for occupants to sit.
3. An Inner Rear Module 16
   a. The inner rear module 16 will be used to hold the gas scrubbing systems, batteries, oxygen, air cylinders 48 and cooling systems.
4. An Outer Rear Module 18
   a. The outer rear module 18 will slide over the inner rear module 16 and have solid fixing along the flange joints where both meet, using bolts and nuts. This area will also be fitted with a seal 40 as to stop any gas entering the jointed modules.
   b. The outer rear module 18 will have removable seats 30 attached to each side wall for occupants to sit.
5. A Center Module 20

The center module 20 is used as an infill option that can be fitted to make the shelter 10 larger at any time to seat a greater number of miners. The center module 20 will connect with the front outer and read outer flanges using bolts and nuts, and these joints will also be fitted with seals to stop gas entering the chamber 24.

Major Features of the Sliding Modular Shelter 10 are.

1. Small compact and easily movable.
2. Two sections form the same dimension as one prior art shelter.
3. Shelter 10 can be expanded to suit any mining application.
4. Modular design protects the equipment from damage because it is shipped fully fitted out.
5. Lighter weight section provides greater strength due to the flange connecting point strength.
6. Cost-effective shipping and lower transport and freight expense because 2 sections have the footprint of one piece.
7. Greater number of shelters 10 can be freighted at one time due to the unique design.

Figure 13:
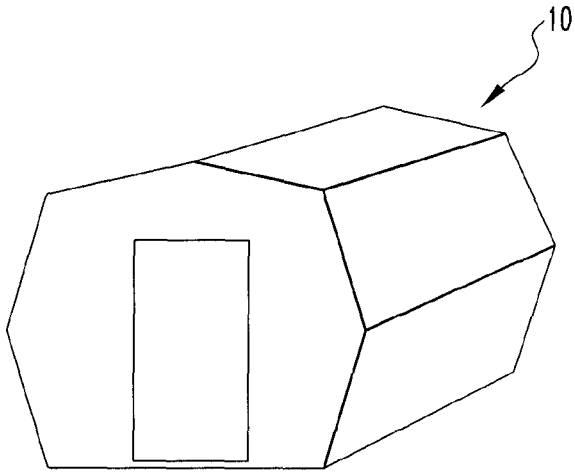
FIG. 13 is a schematic diagram of an alternative design of a shelter.
Figure 14:
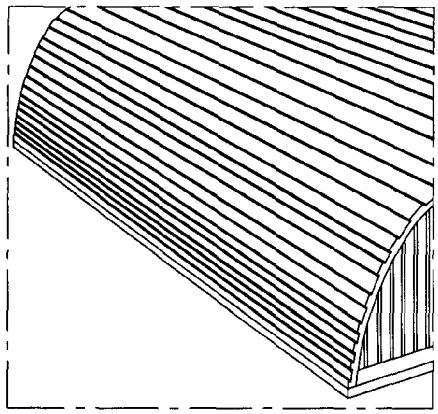
FIG. 14 is a schematic diagram of another alternative design of a shelter.

In alternative embodiments, rather than a curved shape, as shown in FIG. 9, the shelter roof and side walls can have a slight fold is to increase strength, and assist with alignment of the inner and outer modules, as shown in FIG. 13. Alternatively, the roof and side walls may be made from thick corrugated steel plate, as shown in FIG. 14. All other features of the shelter 10 remain the same, i.e. flange assembly, module size, etc.

The shelter 10 is designed for tight entry ways and addresses the difficulty of placing large safety shelter 10 into these tight situations, The shelter may be used in the following industries:

1. COAL MINES (Mines that require explosion proof structures)
2. NON COAL MINES (also known as Hard rock, these mines include all mining types; metal, non-metal, precious metals, salt and limestone.

3. Other applications including but not limited to, tunnel building, chemical plants, toxic environments.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A shelter from an external environment comprising:

an inner front module having a flat base and side walls which extend from the base and an airlock;

an outer front module which is slidingly attached to the inner front module, the outer front module slides over the inner front module between a compact state, where the outer from module envelops the inner front module, and an extended state, where the inner front module extends from the outer front module and there is an airtight seal between the inner front module and the outer front module, the outer front module having a front attachment portion;

an inner rear module; and an outer rear module which is slidingly attached to the inner rear module, the outer rear module slides over the inner rear module between a compact state where the outer rear module envelops the inner rear module, and an extended state where the inner rear module extends from the outer rear module and there is an airtight seal between the inner rear module and the outer rear module, the outer rear module having a rear attachment portion through which the outer rear module is attached to the front attachment portion of the outer front module, when the outer front module and the inner front module are in the extended state and the outer rear module and the inner rear module are in the extended state and the outer front module and outer rear module are attached, the outer front and rear modules and the inner front and rear modules form an airtight chamber in which users are protected from the external environment, each attachment portion is an external flange, and there is an external seal between each attachment portion that are attached together, when in the compact state, an inner front flange of the inner front module and the front attachment portion of the outer front module are flush and separate and apart from the inner and outer rear modules, and a bracket attached to the inner front module and outer front module when the inner and outer front modules are in the compact state to maintain the inner and outer front modules in the compact state.

2. The shelter of claim 1 including a center module having a center front attachment portion through which the center module is removably attached to the front attachment portion of the outer front module, and a center rear attachment portion through which the center module is removably attached to the rear attachment portion of the outer rear module, when the center module is attached to the outer rear module and the outer front module, the outer front and rear modules and the inner front and rear modules and center front and rear modules form the airtight chamber.

3. The shelter of claim 2 wherein the inner rear module has a gas scrubber for removing $CO_2$ from the airtight chamber.

4. The shelter of claim 3 wherein the inner rear module has breathable gas cylinders for supplying breathable gas to the airtight chamber.

5. The shelter of claim 4 wherein the airlock of the inner front module has breathable gas cylinders for purging the airlock.

6. The shelter of claim 5 wherein the airlock has an airlock purge valve through which gas above a certain pressure in the airlock escapes to the external environment.

7. The shelter of claim 6 wherein the airlock has a pressure valve in fluid communication with the chamber through which gas in the airtight chamber escapes when the gas pressure in the chamber is above a predetermined level.

8. The shelter of claim 7 wherein the outer front module and the inner outer rear module have seats for users to sit in and the inner front module has a toilet.

9. The shelter of claim 8 wherein each module is made of metal.

10. The shelter of claim 9 wherein the inner rear module includes batteries and a cooling system.

11. The shelter of claim 10 wherein the outer front module has a loop by which the outer front module is lifted and placed in a transfer cage to be lowered into a mine.

12. A method for constructing a shelter to protect users from an external environment comprising the steps of:

extending an inner front module having an airlock from an outer front module which is slidingly attached to the inner front module from a compact state, where the outer front module envelops the inner front module, to an extended state, where the inner front module extends from the outer front module and there is an airtight seal between the inner front module and the outer front module, the outer front module slides over the inner front module between a compact state and an extended state, the outer front module having a front attachment portion, the front attachment portion is an external flange;

extending an inner rear module from an outer rear module which is slidingly attached to the inner rear module from a compact state, where the outer rear module envelops the inner rear module, to an extended state, where the inner rear module extends from the outer rear module and there is an airtight seal between the inner rear module and the outer rear module, the outer rear module slides over the inner rear module between a compact state and an extended state, the outer rear module having a rear attachment portion, the rear attachment portion is another external flange, and there is an external seal between the front attachment portion and the rear attachment portion when the front attachment portion and the rear attachment portion are attached together, when in the compact state, an inner front flange of the inner front module and the front attachment portion of the outer front module are flush and separate and apart from the inner and outer rear modules, and a bracket attached to the inner front module and outer front module when the inner and outer front modules are in the compact state to maintain the inner and outer front modules in the compact state; and attaching the outer front module to the outer rear module through the front attachment portion of the outer front module and the rear attachment portion of the outer rear module to form an airtight chamber in which users are protected from the external environment.

13. The method of claim 12 including the steps of attaching a center module to the outer front attachment portion through a center front attachment portion of the center module and the front attachment portion of the outer front module, and attaching the center portion to the outer rear portion through a center rear attachment portion and to the rear attachment portion of the outer rear module to form the airtight chamber.

14. The method of claim 13 including the steps of moving the inner and outer front module in the compact state to a desired location, moving the inner and outer rear module in a compact state to a desired location adjacent the inner and outer front module, and moving the center module to a desired location adjacent the inner and outer front module.

15. The method of claim 14 wherein the moving the inner and outer front modules in the compact state includes the step of moving the inner and outer front modules in the compact state with the bracket attached to the inner and outer front modules to hold the inner and outer front modules in the compact state.

* * * * *